US011337568B1

(12) United States Patent
Kim

(10) Patent No.: US 11,337,568 B1
(45) Date of Patent: May 24, 2022

(54) TOILET PAPER ROLL HOLDER

(71) Applicant: Ji Rook Kim, Ridgefield, NJ (US)

(72) Inventor: Ji Rook Kim, Ridgefield, NJ (US)

( * ) Notice: Subject to any disclaimer, the term of this patent is extended or adjusted under 35 U.S.C. 154(b) by 50 days.

(21) Appl. No.: 17/121,952

(22) Filed: Dec. 15, 2020

(51) Int. Cl.
*A47K 10/38* (2006.01)

(52) U.S. Cl.
CPC .. *A47K 10/3836* (2013.01); *A47K 2010/3863* (2013.01)

(58) Field of Classification Search
CPC .... A47K 10/38; A47K 10/3836; B65H 16/04; B65H 18/026
See application file for complete search history.

(56) References Cited

U.S. PATENT DOCUMENTS 1,674,285 A * 6/1928 Harvey ..... A47K 10/3836 242/571.5
1,825,822 A * 10/1931 Rundell ..... A47K 10/3836 242/571.5
2,073,429 A * 3/1937 Spicher ..... A47K 10/3836 492/42
2,613,041 A * 10/1952 Cantrell ..... A47K 10/3836 242/571.5
3,227,386 A * 1/1966 Pitcher ..... A47K 10/3836 248/302
4,235,389 A * 11/1980 Ness ..... A47K 10/3836 242/130
4,595,153 A * 6/1986 Goetz ..... A47K 10/3836 242/597
4,690,343 A * 9/1987 Goetz ..... A47K 10/3836 242/597
6,651,922 B1 * 11/2003 Quimpo ..... A47K 10/3836 242/537
7,306,185 B1 12/2007 Miller
10,368,703 B2 8/2019 Traub
10,512,369 B2 12/2019 Cuenca et al.
2003/0189126 A1 10/2003 Hale
2020/0268220 A1 * 8/2020 Hong ..... A47K 10/22

* cited by examiner

*Primary Examiner* — William A. Rivera
(74) *Attorney, Agent, or Firm* — JIKIM LLC—Attorneys at Law; Jisang Kim, Esq.

(57) ABSTRACT

The present invention is a toilet paper roll holder that includes a pair of elongate arms, a vertical support, and a base member. Each of the elongate arms has a first surface. The first surface corresponding to each of the elongate arms are curved to have a roll of toilet paper positioned thereon. Each of the elongate arms has a second surface. The second surface corresponding to each of the elongate arms are biased inwardly therein. The second surface corresponding to each of the elongate arms face each other. Each of the elongate arms is secured to the vertical support. The vertical support is positioned between the elongate arms. The vertical support has the elongate arms being spaced apart from each other providing tension to the elongate arms to retain the roll of toilet paper. The base member has a top surface and a peripheral edge. The vertical support is secured to the top surface of the base member. Each of the elongate arms, the vertical support, and the base member are formed from a rigid or a semi-rigid material.

20 Claims, 4 Drawing Sheets

TOILET PAPER ROLL HOLDER

TECHNICAL FIELD & BACKGROUND

The present invention generally related to a toilet paper roll holder, and in particular, to an improved toilet paper roll holder. A traditional toilet roll holder requires two hands to operate in order to keep the toilet roll from unrolling; one hand to hold the roll and the other hand to pull from the roll. When a user uses such traditional roll holder, it is almost impossible for the user to just tear a piece off with his or her one hand. The user has to use two hands, reaching across his or her body to tear off the toilet paper. If the user only uses one hand, the user either won't be able to tear the paper or it won't tear along the line or will tear too early. Therefore, it would be desirable to provide an improved toilet paper roll holder that could allow a user to tear off toilet paper using only one hand by keeping the toilet roll from unrolling.

SUMMARY OF THE INVENTION

The present invention is directed to a toilet paper roll holder that overcomes the above-mentioned disadvantages of the prior art.

In one aspect, the present invention provides a toilet paper roll holder having a first elongate arm, a second elongate arm, a vertical support, and a base member. The first elongate arm has a first surface, a second surface and a third surface. The first surface is curved to have a roll of toilet paper positioned thereon. The second surface is biased inwardly therein. The third surface is positioned between the first surface and the second surface. The second elongate arm has a first surface, a second surface, and a third surface. The first surface is curved to have the roll of toilet paper positioned thereon. The second surface is biased inwardly therein. The third surface is positioned between the first surface and the second surface. The second surface of the first elongate arm faces the second surface of the second elongate arm. The third surface of the first elongate arm and the third surface of the second elongate arm are in spaced parallel relationship. The second elongate arm has an identical material and thickness of the first elongate arm. The vertical support member has a first end and a second end. The first elongate arm is secured to the first end. The second elongate arm is secured to the second end. The vertical support is positioned between the first and second elongate arms. The vertical support has the first and second elongate arms being spaced apart from each other providing tension to the first and second elongate arms to retain the roll of toilet paper. The base member has a top surface and a peripheral edge. The vertical support is secured to the top surface of the base member. The first elongate arm, the second elongate arm, the vertical support, and the base member are formed from a rigid or a semi-rigid material.

In another aspect, the present invention provides a toilet paper roll holder having a pair of elongate arms, a vertical support, and a base member. Each of the elongate arms has a first surface. The first surface corresponding to each of the elongate arms are curved to have a roll of toilet paper positioned thereon. Each of the elongate arms has a second surface. The second surface corresponding to each of the elongate arms are biased inwardly therein. The second surface corresponding to each of the elongate arms face each other. Each of the elongate arms is secured to the vertical support. The vertical support is positioned between the elongate arms. The vertical support has the elongate arms being spaced apart from each other providing tension to the elongate arms to retain the roll of toilet paper. The base member has a top surface and a peripheral edge. The vertical support is secured to the top surface of the base member. Each of the elongate arms, the vertical support, and the base member are formed from a rigid or a semi-rigid material.

In a further aspect, the present invention provides a toilet paper roll holder having a first elongate arm, a second elongate arm, a vertical support, and a base member. The first elongate arm has a first surface and a second surface. The first surface is curved to have a roll of toilet paper positioned thereon. The second surface is biased inwardly therein. The second elongate arm has a first surface and a second surface. The first surface is curved to have the roll of toilet paper positioned thereon. The second surface is biased inwardly therein. The second surface of the first elongate arm faces the second surface of the second elongate arm. The vertical support member has a first end and a second end. The first elongate arm is secured to the first end. The second elongate arm is secured to the second end. The vertical support is positioned between the first and second elongate arms. The second elongate arm has an identical material and thickness of the first elongate arm. The vertical support has the first and second elongate arms being spaced apart from each other providing tension to the first and second elongate arms to retain the roll of toilet paper. The base member has a top surface. The vertical support is secured to the top surface of the base member. The first elongate arm, the second elongate arm, the vertical support, and the base member are formed from a rigid or a semi-rigid material.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments. Various operations will be described as multiple discrete operations, in turn, in a manner that is most helpful in understanding the present invention. However, the order of description should not be construed as to imply that these operations are necessarily order dependent. In particular, these operations need not be performed in the order of presentation. The phrase "in one embodiment" is used repeatedly. The phrase generally does not refer to the same embodiment, however, it may. The terms "comprising", "having" and "including" are synonymous, unless the context dictates otherwise.

This present invention provides a toilet paper roll holder 100 that could allow a user to tear off toilet paper using only one hand without unrolling the roll.

Figure 1:
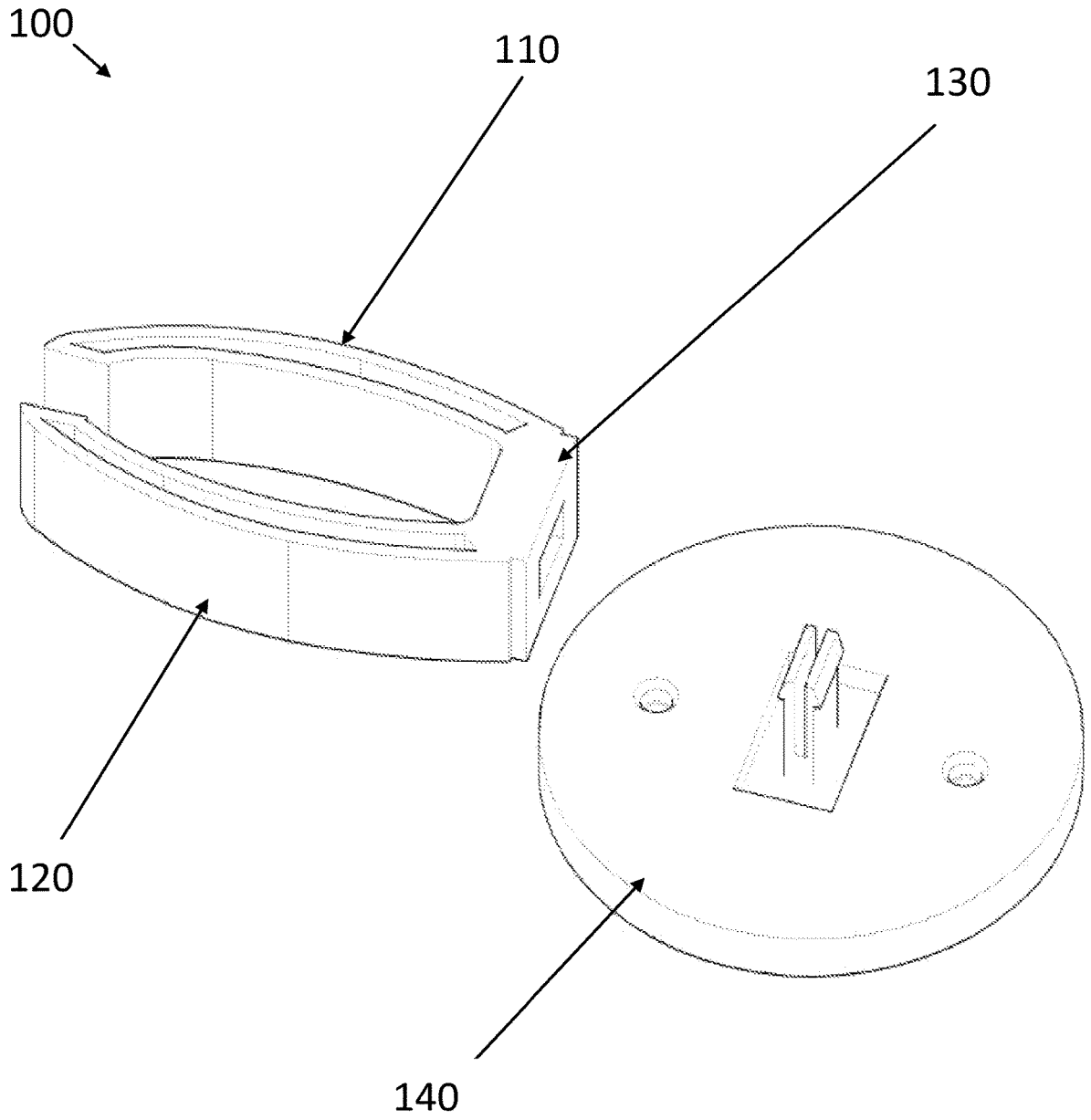
FIG. 1 illustrates a perspective view of a toilet paper roll holder, in accordance with one embodiment of the present invention.

FIG. 1 illustrates a perspective view of a toilet paper roll holder 100, in accordance with one embodiment of the present invention.

Referring to FIG. 1, a toilet paper roll holder 100 includes a first elongate arm 110, a second elongate arm 120, a vertical support 130, and a base member 140.

Figure 2:
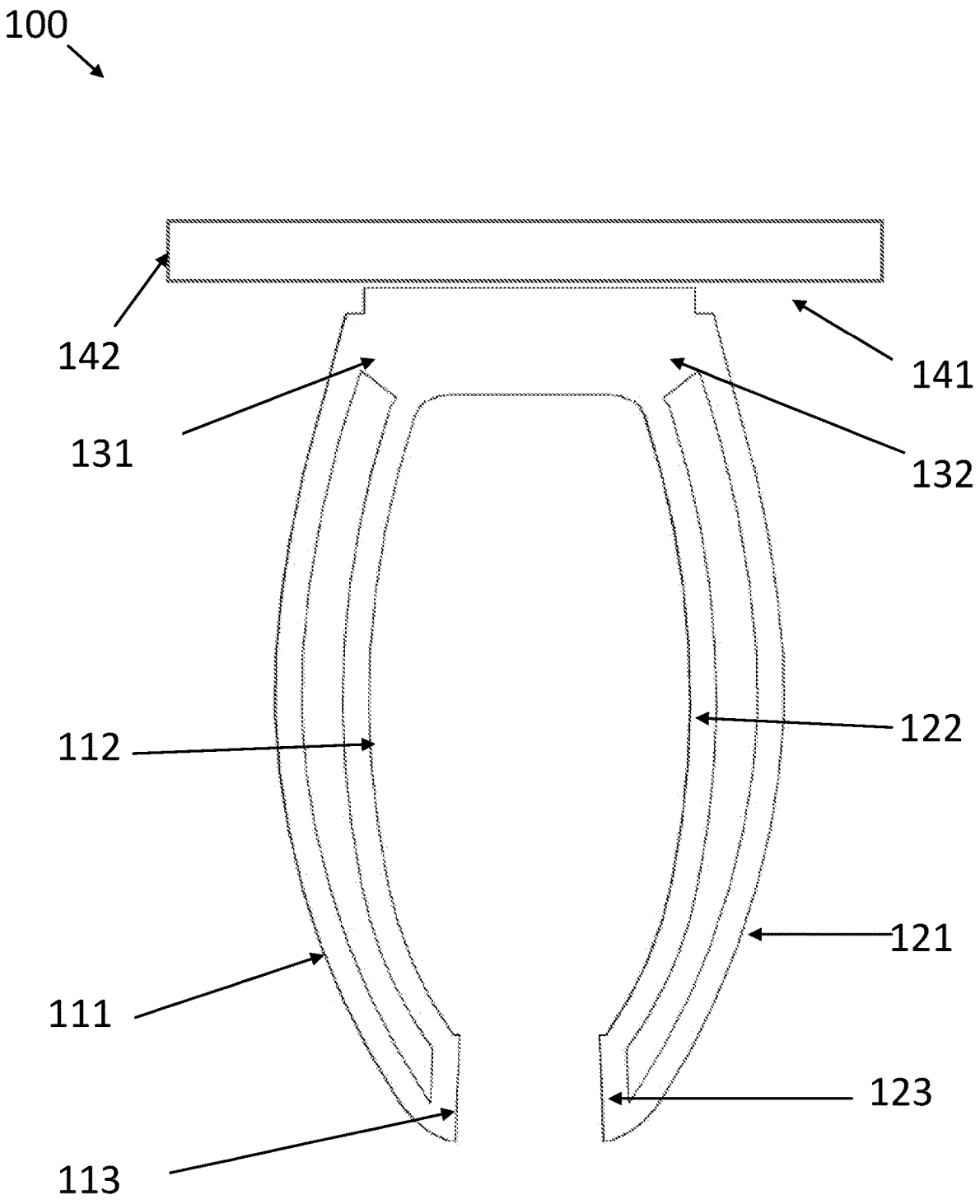
FIG. 2 illustrates a top view of a toilet paper roll holder, in accordance with one embodiment of the present invention.

FIG. 2 illustrates a top view of a toilet paper roll holder, in accordance with one embodiment of the present invention.

Referring to FIGS. 1 and 2, the first elongate arm 110 has a first surface 111, a second surface 112 and a third surface 113. The first surface 111 is curved to have a roll of toilet paper positioned thereon. The second surface 112 is biased inwardly therein. The third surface 113 is positioned between the first surface 111 and the second surface 112. The second elongate arm 120 has a first surface 121, a second surface 122, and a third surface 123. The first surface 121 is curved to have the roll of toilet paper positioned thereon. The second surface 122 is biased inwardly therein. The third surface 123 is positioned between the first surface 121 and the second surface 122. The second surface 112 of the first elongate arm 110 faces the second surface 122 of the second elongate arm 120. The third surface 113 of the first elongate arm 110 and the third surface 123 of the second elongate arm 120 are in spaced parallel relationship. The second elongate arm 120 has an identical material and thickness of the first elongate arm 110.

Preferably, the first elongate arm 110 and the second elongate arm 120 may comprise one or more materials selected from the group consisting of: metal, plastic, and rubber. The first elongate arm 110 and the second elongate arm 120 may comprise material suitable for graphic decoration. The first elongate arm 110 and the second elongate arm 120 may further provide a convenient surface to graphically decorate such as drawings or text.

The vertical support 130 has a first end 131 and a second end 132. The first elongate arm 110 is secured to the first end 131. The second elongate arm 120 is secured to the second end 132. The vertical support 130 is positioned between the first and second elongate arms 110, 120. The vertical support 130 has the first and second elongate arms 110, 120 being spaced apart from each other providing tension to the first and second elongate arms 110, 120 to retain the roll of toilet paper.

Preferably, the first elongate arm 110 and the second elongate arm 120 can be secured to the vertical support 130 in a variety of ways, including heat welding and adhesives. However, the first elongate arm 110 and the second elongate arm 120 are preferably secured to the vertical support 130 via a heat welding that securely holds the first elongate arm 110 and the second elongate arm 120 in position. The vertical support 130 may have the first and second elongate arms 110, 120 being spaced apart from each other providing tension to the first and second elongate arms 110, 120 to retain the roll of toilet paper in position keeping the toilet roll from unrolling. The first elongate arm 110, the second elongate arm 120, and the vertical support 130 together may be a one-piece construction formed of plastic in a single operation. The first elongate arm 110, the second elongate arm 120, and the vertical support 130 may further comprise at least one of a waterproof material and a water resistant material.

Figure 3:
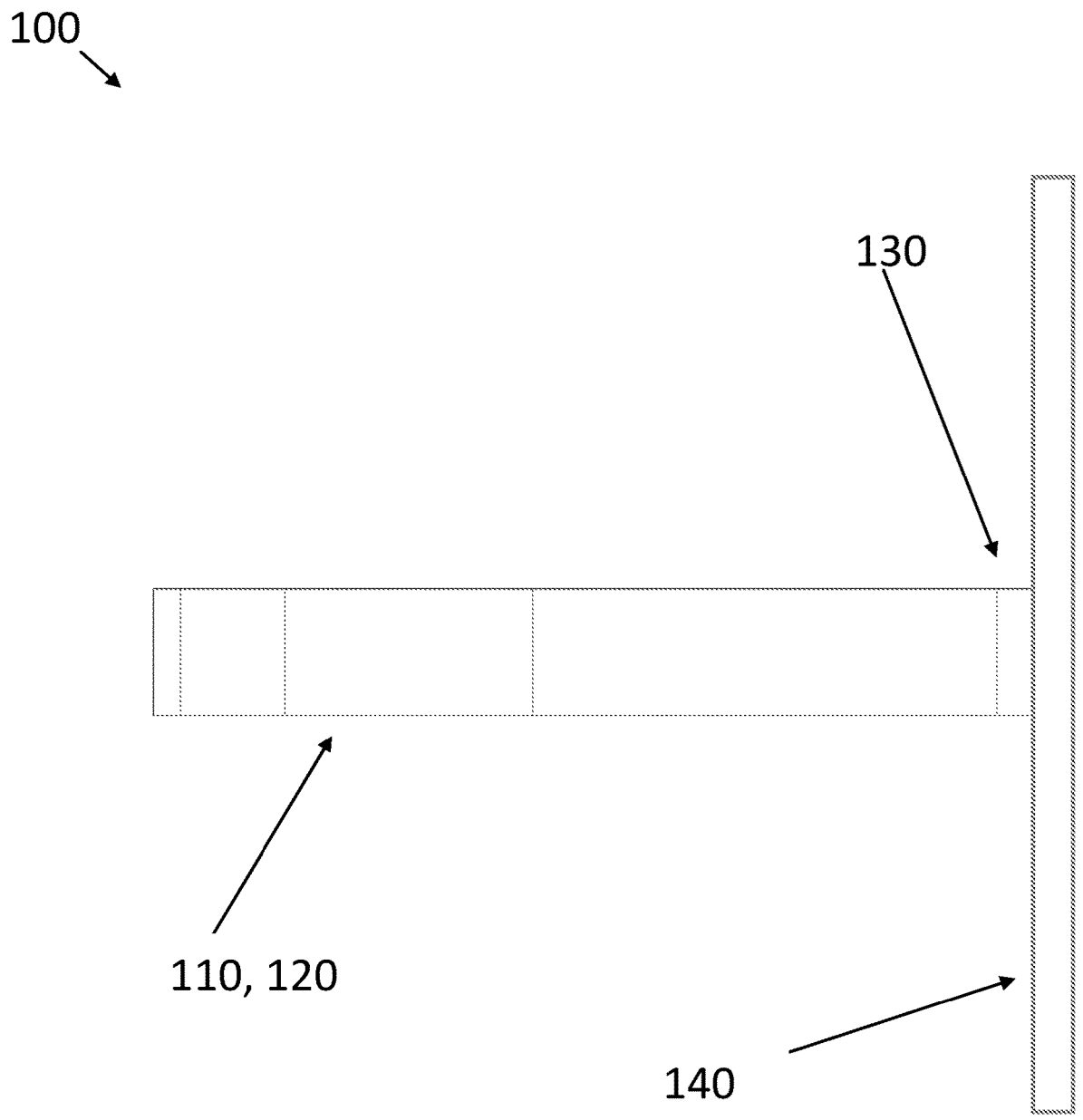
FIG. 3 illustrates a side view of a toilet paper roll holder, in accordance with one embodiment of the present invention.
Figure 4:
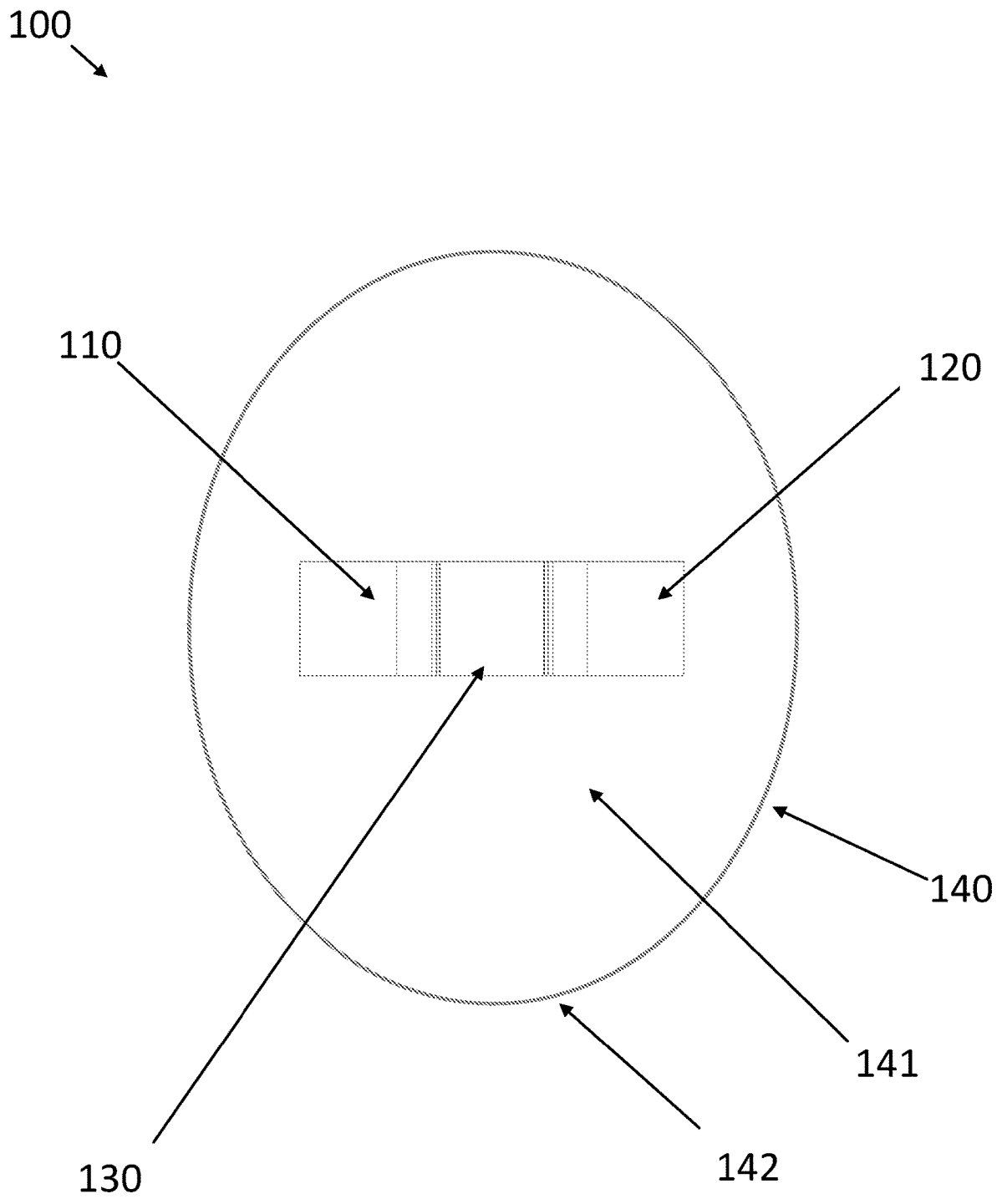
FIG. 4 illustrates a front view of a toilet paper roll holder, in accordance with one embodiment of the present invention.

FIG. 3 illustrates a side view of a toilet paper roll holder, in accordance with one embodiment of the present invention. FIG. 4 illustrates a front view of a toilet paper roll holder, in accordance with one embodiment of the present invention.

Referring to FIGS. 3 and 4, the base member 140 has a top surface 141 and a peripheral edge 142. The vertical support 130 is secured to the top surface 141 of the base member 140. The first elongate arm 110, the second elongate arm 120, the vertical support 130, and the base member 140 may be formed from a rigid or a semi-rigid material.

Preferably, the vertical support 130 can be secured to the base member 140 in a variety of ways that holds the vertical support in position when the roll of toilet paper is in use. The vertical support 130 may be secured by heat welding to the top surface 141 of the base member 140. The base member 140 may further comprise a part of a framework configured for attaching to a wall. A logo may be inscribed on the base member 140.

In an exemplary embodiment, and as illustrated in FIGS. 1 and 2, a toilet paper roll holder 100 includes a pair of elongate arms 110, 120, a vertical support 130, and a base member 140. Each of the elongate arms 110, 120 has a first surface 111, 121. The first surface corresponding to each of the elongate arms 111, 121 are curved to have a roll of toilet paper positioned thereon. Each of the elongate arms 110, 120 has a second surface 112, 122. The second surface corresponding to each of the elongate arms 112, 122 are biased inwardly therein. The second surface corresponding to each of the elongate arms 112, 122 face each other.

Preferably, the elongate arms 110, 120 may comprise one or more materials selected from the group consisting of: metal, plastic, and rubber. The elongate arms 110, 120 may further comprise material suitable for graphic decoration.

Each of the elongate arms 110, 120 is secured to the vertical support 130. The vertical support 130 is positioned between the elongate arms 110, 120. The vertical support 130 has the elongate arms 110, 120 being spaced apart from each other providing tension to the elongate arms 110, 120 to retain the roll of toilet paper.

Preferably, the elongate arms 110, 120 and the vertical support 130 together may be a one-piece construction formed of plastic in a single operation. The elongate arms 110, 120 and the vertical support 130 may further comprise at least one of a waterproof material and a water resistant material.

Referring to FIGS. 3 and 4, the base member 140 has a top surface 141 and a peripheral edge 142. The vertical support 130 is secured to the top surface 141 of the base member 140. Each of the elongate arms 110, 120, the vertical support 130, and the base member 140 may be formed from a rigid or a semi-rigid material.

Preferably, the base member 140 may further comprise a part of a framework configured for attaching to a wall. A logo may be inscribed on the base member 140.

Thus, the present invention disclosed herein provides an improved toilet paper roll holder that could allow a user to tear off toilet paper using only one hand by implementing such elongate arms, vertical support and base member that could keep the toilet roll from unrolling when it is in use.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A toilet paper roll holder, comprising:

a first elongate arm having a first surface, a second surface, and a third surface, the first surface being curved to have a roll of toilet paper positioned thereon, the second surface being biased inwardly therein, the third surface being positioned between the first surface and the second surface;

a second elongate arm having a first surface, a second surface, and a third surface, the first surface being curved to have the roll of toilet paper positioned thereon, the second surface being biased inwardly therein, the third surface being positioned between the first surface and the second surface;

wherein the second surface of the first elongate arm faces the second surface of the second elongate arm;

wherein the third surface of the first elongate arm and the third surface of the second elongate arm are in spaced parallel relationship;

wherein the second elongate arm has an identical material and thickness of the first elongate arm;

a vertical support having a first end and a second end, the first elongate arm being secured to the first end, the second elongate arm being secured to the second end, the vertical support being positioned between the first and second elongate arms, the vertical support having the first and second elongate arms being spaced apart from each other providing tension to the first and second elongate arms to retain the roll of toilet paper;

a base member having a top surface and a peripheral edge, the vertical support being secured to the top surface of the base member; and wherein the first elongate arm, the second elongate arm, the vertical support, and the base member are formed from a rigid or a semi-rigid material.

2. The toilet paper roll holder according to claim 1, wherein the first elongate arm and the second elongate arm comprise one or more materials selected from the group consisting of: metal, plastic, and rubber.

3. The toilet paper roll holder according to claim 1, wherein the base member comprises a part of a framework configured for attaching to a wall.

4. The toilet paper roll holder according to claim 1, wherein the first elongate arm and the second elongate arm comprise material suitable for graphic decoration.

5. The toilet paper roll holder according to claim 1, wherein the first elongate arm, the second elongate arm, and the vertical support comprise at least one of a waterproof material and a water resistant material.

6. The toilet paper roll holder according to claim 1, wherein the first elongate arm, the second elongate arm and the vertical support together being a one-piece construction formed of plastic in a single operation.

7. The toilet paper roll holder according to claim 1, wherein a logo is inscribed on the base member.

8. A toilet paper roll holder, comprising:

a pair of elongate arms, a vertical support, and a base member;

wherein each of the elongate arms has a first surface, the first surface corresponding to each of the elongate arms being curved to have a roll of toilet paper positioned thereon;

wherein each of the elongate arms has a second surface, the second surface corresponding to each of the elongate arms being biased inwardly therein, the second surface corresponding to each of the elongate arms facing each other;

wherein each of the elongate arms is secured to the vertical support, the vertical support being positioned between the elongate arms, the vertical support having the elongate arms being spaced apart from each other providing tension to the elongate arms to retain the roll of toilet paper;

the base member having a top surface and a peripheral edge, the vertical support being secured to the top surface of the base member; and wherein each of the elongate arms, the vertical support, and the base member are formed from a rigid or a semi-rigid material.

9. The toilet paper roll holder according to claim 8, wherein the elongate arms comprise one or more materials selected from the group consisting of: metal, plastic, and rubber.

10. The toilet paper roll holder according to claim 8, wherein the base member comprises a part of a framework configured for attaching to a wall.

11. The toilet paper roll holder according to claim 8, wherein the elongate arms comprise material suitable for graphic decoration.

12. The toilet paper roll holder according to claim 8, wherein the elongate arms and the vertical support comprise at least one of a waterproof material and a water resistant material.

13. The toilet paper roll holder according to claim 8, wherein the elongate arms and the vertical support together being a one-piece construction formed of plastic in a single operation.

14. The toilet paper roll holder according to claim 8, wherein a logo is inscribed on the base member.

15. A toilet paper roll holder, comprising:

a first elongate arm having a first surface and a second surface, the first surface being curved to have a roll of toilet paper positioned thereon, the second surface being biased inwardly therein;

a second elongate arm having a first surface and a second surface, the first surface being curved to have the roll of toilet paper positioned thereon, the second surface being biased inwardly therein;

wherein the second surface of the first elongate arm faces the second surface of the second elongate arm;

wherein the second elongate arm has an identical material and thickness of the first elongate arm;

a vertical support having a first end and a second end, the first elongate arm being secured to the first end, the second elongate arm being secured to the second end, the vertical support being positioned between the first and second elongate arms, the vertical support having the first and second elongate arms being spaced apart from each other providing tension to the first and second elongate arms to retain the roll of toilet paper;

a base member having a top surface, the vertical support being secured to the top surface of the base member; and wherein the first elongate arm, the second elongate arm, the vertical support, and the base member are formed from a rigid or a semi-rigid material.

16. The toilet paper roll holder according to claim 15, wherein the first elongate arm and the second elongate arm comprise one or more materials selected from the group consisting of: metal, plastic, and rubber.

17. The toilet paper roll holder according to claim 15, wherein the base member comprises a part of a framework configured for attaching to a wall.

18. The toilet paper roll holder according to claim 15, wherein the first elongate arm and the second elongate arm comprise material suitable for graphic decoration.

19. The toilet paper roll holder according to claim 15, wherein the first elongate arm, the second elongate arm, and the vertical support comprise at least one of a waterproof material and a water resistant material.

20. The toilet paper roll holder according to claim 15, wherein the first elongate arm, the second elongate arm, and the vertical support together being a one-piece construction formed of plastic in a single operation.

* * * * *